United States Patent [19]

Stemmle

[11] Patent Number: 4,781,371

[45] Date of Patent: Nov. 1, 1988

[54] SHEET COLLECTOR

[75] Inventor: Denis J. Stemmle, Webster, N.Y.

[73] Assignee: Xerox Corporation, Stamford, Conn.

[21] Appl. No.: 886,583

[22] Filed: Jul. 16, 1986

[30] Foreign Application Priority Data

Jul. 17, 1985 [GB] United Kingdom ..... 8518086

[51] Int. Cl.[4] ..... B65H 39/115

[52] U.S. Cl. ..... 271/293; 271/188; 271/209; 271/212; 271/294

[58] Field of Search ..... 271/209, 212, 216, 220, 271/161, 292–295, 177, 178, 181, 188

[56] References Cited

U.S. PATENT DOCUMENTS

| | | | |
|---|---|---|---|
| 2,884,243 | 4/1959 | Stobb | 271/178 |
| 3,148,879 | 9/1964 | Kistner | 271/181 X |
| 3,591,171 | 7/1971 | Schmidt | 271/188 |
| 3,870,295 | 3/1975 | Kukucka | 271/173 |
| 4,134,581 | 1/1979 | Johnson | 271/288 |
| 4,141,546 | 2/1979 | Queener | 271/173 |
| 4,328,963 | 5/1982 | DuBois et al. | 271/293 |
| 4,332,377 | 6/1982 | DuBois | 271/293 |
| 4,466,608 | 8/1984 | DuBois | 271/293 |
| 4,478,406 | 10/1984 | DuBois | 271/293 |

FOREIGN PATENT DOCUMENTS

| | | | |
|---|---|---|---|
| 0020900 | 1/1981 | European Pat. Off. . | |
| 216861 | 12/1983 | Japan | 271/293 |
| 649419 | 1/1951 | United Kingdom . | |
| 2101101B | 5/1985 | United Kingdom . | |

OTHER PUBLICATIONS

Xerox Test Bulletin Competitive Test Program–IBM Copier II, Convenience Collator–Report No. C232–1–5–01, Accession No. X7704412, Oct. 1977.

*Primary Examiner*—Richard A. Schacher
*Attorney, Agent, or Firm*—William A. Henry, II

[57] ABSTRACT

A compact sheet stacker or sorter for a xerographic or other copier has respectively one or more upright sheet-receiving bins which are fed from below by a guide assembly which, in the case of a sorter, can be indexed from bin to bin but, in the case of a stacker is fixed. With this arrangement sheets are collected in properly collated (1−N) order without using an active sheet inverter or conventional inverting paper path, thereby saving space. Bin plates defining the bins are shaped so as to hold sheets in a curved configuration transverse to the direction of sheet feed. The curvature imparts beam strength to the sheets enabling them to stand on edge even when the sheets extend above the tops of the bins. A stacker or sorter with relatively short bins can therefore handle a variety of sheet sizes without adjustment.

11 Claims, 4 Drawing Sheets

SHEET COLLECTOR

Figure 1:
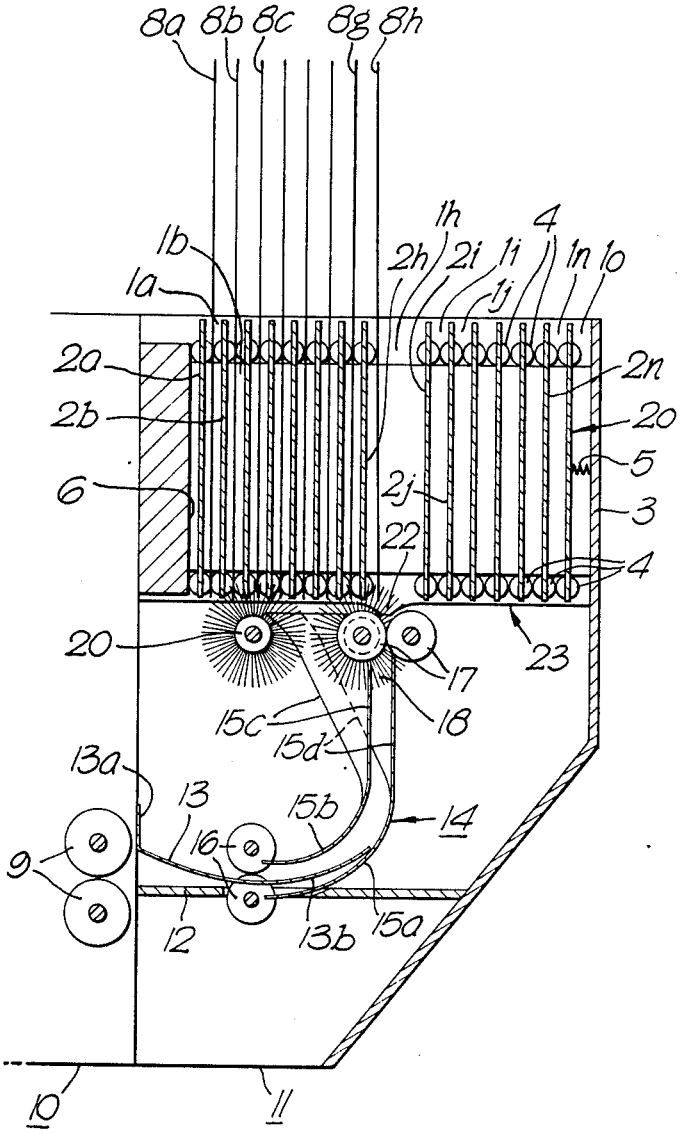

This invention relates to a sheet collector, that is to say, apparatus for stacking or sorting sheets, particularly copy sheet issuing from a xerographic or other copier.

When copying a multi-sheet simplex document it is generally desirable to present the individual sheets for copying in 1—N order, that is to say in their natural sequence with page 1 first and the final page last. Because the copier usually ejects sheets with copy side up, prior art stackers or sorters frequently include some form of inverting means in the form of an active sheet inverter or an inverting paper path so that simplex copy sheets are properly collated in 1—N order in the sorter bins. However, such inverting means tend to occupy considerable space and therefore they are sometimes dispensed with, for example in so-called "compact" arrangements where (as the name implies) space saving is the aim in order to reduce the overall size of the collecting device. Unfortunately, this has the drawback that the operator then has the inconvenience of rearranging the document sheets for copying in N—1 order so that the last page of the document is copied first and page 1 is copied last.

As used herein the term "simplex" relates to sheets bearing information on only one side.

Commonly assigned copending patent applications, U.S. Ser. No. 102,177, filed in the U.S. on Sept. 29, 1977, entitled "Sheet Sorters" and U.S. Ser. No. 102,068, filed in the U.S. on Sept. 29, 1987, entitled "Sheet Collector" disclose a sorter having a plurality of generally upright sheet-receiving bins with each bin having a shape which automatically curves each sheet as it is being fed in, so as to give the sheet sufficient beam strength for the projecting part of each sheet to be selfsupporting and a bottom-fed sheet collector that includes at least one upright bin for receiving sheets with a guide means for directing the sheets into the bin(s) and a scoop for lifting the trail edge of the sheets from the guide means into the bin(s), respectively.

PRIOR ART

Various tray and sorter designs in the past include U.K. Patent GB No. 2,101,101 B which relates to a paper tray having a plane supporting surface inclined to a horizontal surface that has a transverse depression whereby a stack of sheets in the tray can be pressed by hand into the depression causing the stack and portions to flex upwardly enabling the top sheets to be removed more easily. U.K. Patent Specification No. 649,419 relates to a sheet feeding apparatus having a generally horizontal, convex base-plate. A sorter apparatus is shown in U.S. Pat. No. 3,870,295 that includes generally upright bins. IBM's Copier II has a sorter attachment that delivers copies vertically up into bins. The copies are held in place by spring fingers. One example of such an attachment is U.S. Pat. No. 4,141,546. U.S. Pat. Nos. 4,328,963 and 4,466,608 disclose sheet stacking devices in which a plurality of inclined, curved bins are utilized to cause sheets of paper entering the bins to be arched, thereby resisting sagging or bending over the ends of the trays.

According to the present invention there is provided a bottomfed sheet collector comprising one or more upstanding sheet-receiving bins adapted to hold sheets in a substantially curved configuration transverse to the direction of sheet feed, whereby the sheets are able to stand on edge and upright in the bins by virtue of the beam strength thus imparted to them.

It is noted here that a sheet collector in accordance with the invention may be either a stacker or a sorter. Thus when it is desired to sort sheets the collector (sorter) may comprise a plurality of bins and including indexed guide means for directing successive sheets towards each of the bins in turn. Alternatively it it is desired merely to stack rather than to sort sheets the collector (stacker) may comprise only a single bin, in which case the guide means for direction sheets into the bin can be fixed.

A sheet sorter or stacker in accordance with the invention has the advantage that face-up simplex copy sheets in 1—N sequence are properly collated in 1—N order, without using an active sheet inverter or a conventional inverting path. The collecting device can therefore have a compact configuration with the significant benefit that the document sheets do not have to be presented in reverse order for copying.

The curved configuration in which the sheets are held in the bin(s) imparts beam strength to the sheets so that they stand upright, preventing them from collapsing to the bottoms of the bin(s). For optimum compactness, the height of the collector bin(s) may be substantially less than the corresponding dimension of the sheets to be collected therein. In this case the leading edges of the sheets will project beyond the bin(s), the imparted beam strength being sufficient that the protruding portions of the sheet will be self-supporting. This is advantageous because it means that a collector with a very compact configuration can handle a variety of sheet sizes without requiring any adjustment. An arrangement in which the sheets extend beyond the tops of the bin(s) has the further advantage that it is easier for the operator to check copy quality by direct inspection. Also, it allows easier access to the copy sheets, which simplifies unloading from the bin(s).

The bin(s) which hold the sheets in a substantially curved configuration are defined by upstanding plates which may be curvilinear. Alternatively each of the plates may comprise several substantially flat sections, adjacent sections being mutually inclined transverse to the direction of sheet feed. The flat sections are so arranged that sheets in the bins) are constrained to adopt a substantially curved configuration as discussed in more detail below.

Figure 2:
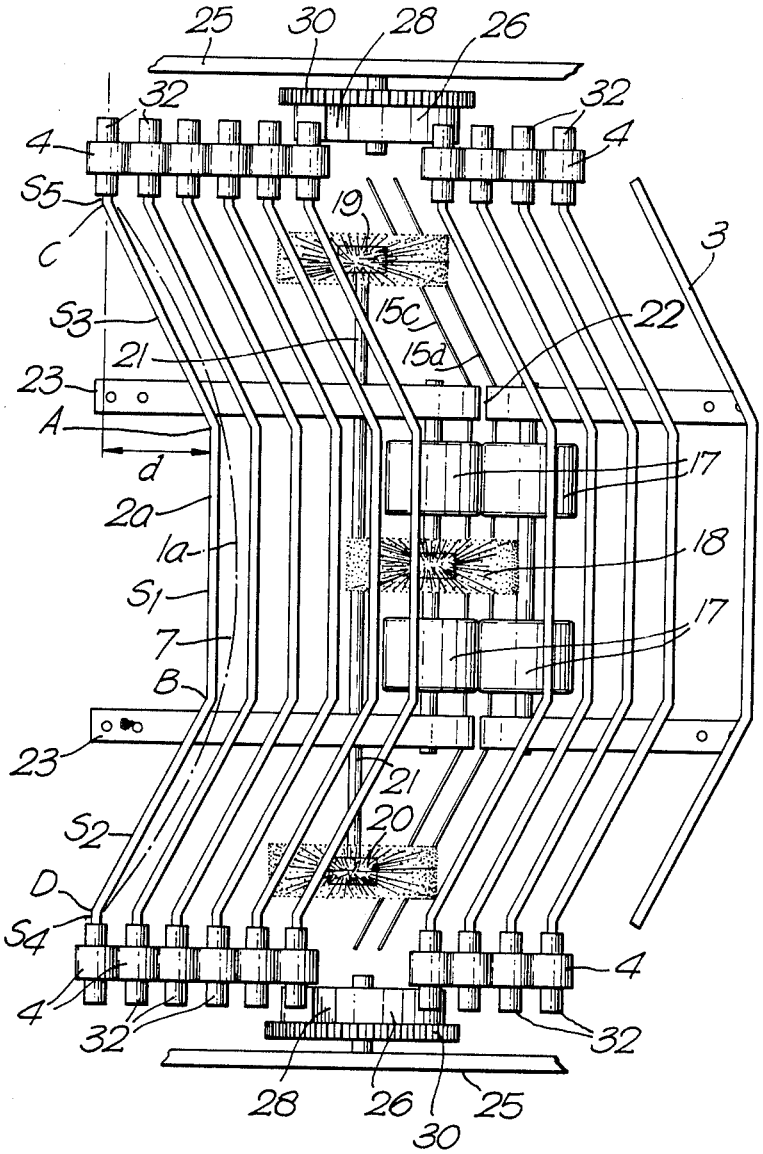
Figure 3:
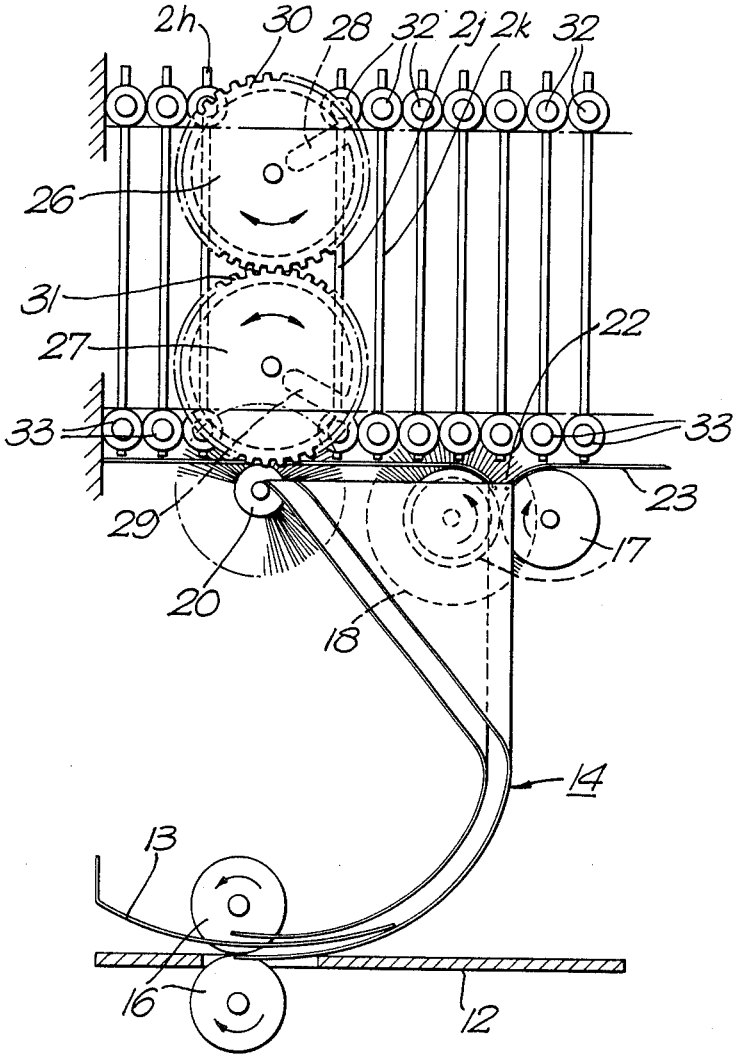
Figure 4:
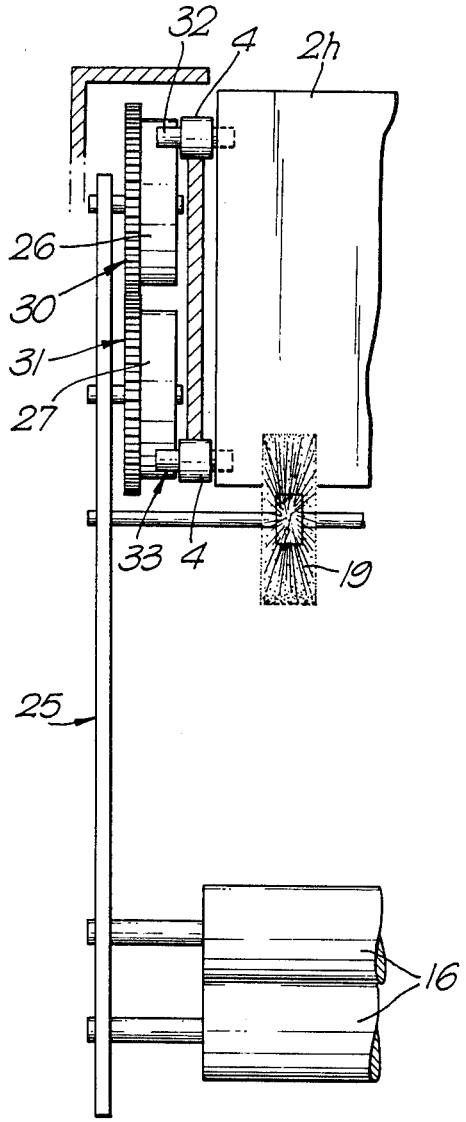

An embodiment of the invention will now be described, by way of example, with reference to the accompanying drawings, in which:

FIG. 1 is a schematic cross section of a bottom-fed sheet sorter in accordance with the present invention, FIG. 2 is a plan view of part of the sorter in FIG. 1, FIG. 3 is a side elevation of the sorter showing the indexing mechanism, and FIG. 4 is a front elevation of part of the transport carriage in the sorter.

Referring to FIGS. 1 to 3, the sorter comprises fifteen vertical bins 1*a*, 1*b*, 1*c* . . . 1*n*, 1*o* for receiving respective sets of copy sheets, but this is merely exemplary and a sorter in accordance with the invention may comprise more or less bins. The bins are defined by a parallel array of vertically arranged plates 2*a*, 2*b*, 2*c*, . . . 2*n*, 2*o*. Thus bin 1*a* is defined by plates 2*a* and 2*b*, bin 1*b* is defined by plates 2*b* and 2*c* and so on up to bin 1*n* which is defined by plates 2*n* and 2*o*. The last bin 1*o* is defined by the plates 2*o* and the back wall 3 of the sorter. As will be described in more detail below the plates can be moved apart and together so that a particular bin can be opened wider for a sheet to be fed into it and subsequently the bin is closed. In FIG. 1 bin 1*h* is shown opened wider than the other bins having just received the copy sheet 8*h*. Typically the spacing of the bin plates may be varied between, for example, 10 mm in the closed position and 25 mm in the open position. The spacing in the closed position is set by spacers 4, each plate having four such spacers located respectively towards the top and bottom at both sides of the plate. The spacers 4 may be made of rubber for example. The array of bin plates is biased together by springs 5 acting against the outermost plate 1*o* urging the plates from right to left as shown in the drawing against an abutment 6 adjacent plate 1*a*. The bins are thus normally kept in their closed position, an individual bin being opened only to receive an incoming copy sheets as described in more detail below. As can be seen from FIG. 2, each of the plates is formed from a flat plate bent in four places. Four bends labelled A, B, C, D on plate 1*a* in FIG. 2 are vertical and define five distinct flat sections S1, S2, S3, S4, S5. Central section S1 is flanked by respective inclined sections S2 and S3 which respectively adjoin side sections S4 and S5. Inclined sections S2 and S3, which may have approximately the same lateral dimensions as central sections S1, are arranged symmetrically with respect to the central section S1 in the present embodiment, although in an alternative embodiment they may be arranged asymetrically.The side sections S4 and S5, which may have significantly shorter lateral dimensions than the other sections are substantially parallel to central section S1. The inclination of sections S2 and S3 is such that the perpendicular distance d measured between either of the side sections S4, S5 and the central section S1, is, for example, approximately 25 mm. With this configuration for the bin plates the sheets contained in a bin will be held in a curved configuration represented in FIG. 2 by the broken line contour 7 shown in bin 1*a*. As mentioned previously, the curved configuration imparts beam strength to the sheets so they stand upright preventing them from collapsing to the bottoms of the bins. As shown in FIG. 1 the sheets 8*a*, 8*b*, 8*c*, . . . 8*h* may project significantly beyond the tops of the bins. For example, more than half the sheet may extend above the top of the bin. However, the beam strength imparted by the curved configuration is sufficient for the protruding portions of the sheets to be self-supporting without sagging or flopping over. When significant portion of the copy sheets extends above the bins it is easy for an operator to check the copy quality and/or to remove the sheets from the bins.

Referring back to FIG. 1, there will now be described the means for feeding copy sheets from the copier to the sorter bins.

The sheet is ejected by nip rolls 9 from the copier 10 into the sorter 11. As shown, the nip rolls 9 are the exit rolls of the part of the copier in which the sheets are processed. The sheet is initially directed onto a flat fixed baffle 12 and guided by a curved flexible guide member 13 towards and into a movable guide assembly 14 which can be indexed laterally for directing sheets to each of the bins 1*a*, 1*b*, . . . 1*n*, 1*o* in turn. As shown in FIG. 1, the guide assembly 14 is aligned for feeding a copy sheet into bin 1*h* which is opened wider than the other bins for receiving the sheet. As shown, bins 1*a* to 1*h* have already received their first copy sheets. The indexing for the guide assembly and the bin opening mechanisms are inter-related and are described in more detail hereinafter with reference to FIGS. 3 and 4.

The guide assembly 14 has a lower portion comprising a pair of 90° curved guide member 15*a*, 15*b* for turning the copy sheet from its substantially horizontal feed direction into a vertical feed direction. In this way a sheet issued into the sorter with its copy face uppermost will be oriented by the guide means to have its copy side facing the left as shown in FIG. 1.

The guide assembly also has an upper portion comprising a pair of sheet-curving guide members 15*c*, 15*d* comprising a central vertical portion flanked by wing portions which become progressively wider towards the exit (top) of the guide member 14 and which are inclined with respect to the central portion such that, as can be seen clearly in FIG. 2, the exit of the guide assembly 14 has the same configuration as the entrance to the bins. Thus, curvature is induced in the sheets as they are fed through the guide assembly 14 such that they are bent into the correct curved configuration for insertion into the bins.

The guide assembly 14 has pairs of driven nip rolls 16 at its entrance. The lead edge of the copy sheet is guided into the nip rolls 16 before the trail edge leaves the rolls 9. The curved flexible guide 13 which directs the sheets to the entrance of the guide assembly 14 is fixed at its end 13*a* remote from the guide assembly 14 to the main frame of the sorter. The other end 13*b* extends into the guide assembly and bears against the lower guide member 15*a*. The curved guide 13 is thus arranged so that the baffle 12 meets it in a tangential manner at the area of the nip rolls 16 whereby the sheet is guided into the nip therebetween. Because of the flexibility of the curved guide 13 the point at which it is tangential to the baffler 12 will move laterally as the guide assembly indexed from left to right (or vice versa) so that the sheet is always directed into the nip of rolls 16 irrespective of their lateral position.

The guide assembly 14 also has two pairs of driven nip rolls 17 at its exit such that the lead edge of the copy sheets enters the rolls 17 before the trail edge leaves the rolls 16. The copy sheet is fed by the rolls 17 into the bin 1*h* aligned above. As the sheet passes from the guide assembly 14 into the bin 1*h* the sheet travels through gaps 22 in a pair of negator springs 23 which extend the full length below the bins. The negator springs 23 act as abutments for the trail edge of the sheets when they are in the bins.

Three rotatable brushes 18, 19, 20 with radially extending bristles are located in the vicinity of the exit of the guide assembly 14 below the bins. A single forward brush 18 is centrally located and may be mounted on the same drive shaft as the two rear exit nip rolls 17. The brush 18 is located at the central portion of the guide assembly exit. Two rear brushes 19, 20 are mounted behind brush 18 on a separate drive shaft 21 and flanking brush 18 so as to be aligned with the side wing portions of the guide assembly exit. The brushes may have bristles made for example of a polymer material and which may be 20–30 mm long extending from a central hub. The bristles of the front brush 18 help to lift the trail edge of the copy sheet out from the exit of the guide assembly 14 and into the bins 1*h*. Then the bristles urge the trail edge towards the plate 2*h*. The bristles of the rear brushes 19, 20 similarly urge side portions of the trail edge of the sheet against the inclined side portions of the plate 2*h* so that as a set of sheets is received in a bin the three brushes 18, 19, 20 together conform the trail edges of all the sheets in the set against bin plate.

When a sheet has been fed into the bin 1*h* the guide assembly 14 is indexed laterally to align the exit with the next bin 1*i*. Also, the bin plates 1*i*, 1*j* defining bin 1*i* are opened wider apart to receive the next sheet. The indexing and bin opening mechanism will now be described with reference to FIGS. 3 and 4.

The whole indexing and bin opening mechanism is mounted on a transport carriage 25 capable of moving from bin to bin across the sorter. A pair of upper and lower genevas 26, 27 each have a single slot 28, 29 and inter-meshing gears 30, 31 respectively, so that the genevas are driven synchronously. As the genevas rotate the slots 28, 29 receive pins 32, 33 which extend horizontally from the spacers 4 at the sides of each of the bin plates. The slots 28, 29 thus receive the pins of bin plate 2i and as the genevas 26, 27 continue rotating the bin plate is moved for example 25 mm across the opened gap to close the last bin 1*h* and open the next bin 1*i* ready to receive the next sheet. As the pins leave the slots the transport carriage 25 and hence the entire transport mechanism is indexed by, for example, 10 mm to align the guide assembly 14 with the next bin 1*i*. The indexing means is bi-directional so that once the desired number of copies (up to a maximum of fifteen) of a particular document sheet have been completed to the transport direction is reversed to receive the next copy sheet. The nip rolls 16, 17 and brushes 18, 19, 20 all of which have drive shafts mounted on the transport carriage 25, are however all uni-directional.

The details of the sheet sorter described above are merely exemplary and it will be evident to a person skilled in the art that various modifications may be made within the scope of the present invention. For example, the sheet receiving bins do not have to be strictly vertical but may be inclined towards the horizontal. Also, instead of being formed from flat plates bent to form adjacent inclined planar sections the bin plates may be curvilinear, in which case the guide assembly may also have a curvilinear configuration for bending the sheets into the correct curvature for feeding into the bins.

Finally, it is noted that the collecting device described above is a multi-bin sorter. However, a sheet collector in accordance with the invention can also be a sheet stacker in which case only a single bin is required and the guide means for directing sheets into the bin can be fixed.

What is claimed is:

1. A bottom-fed sheet collector comprising one or more upstanding sheet-receiving bins having sheet support surface(s) that include irregular sheet support surface portions adapted to hold the sheets while they are in said one or more upstanding sheet-receiving bins in a substantially curved configuration transverse to the direction of sheet feed, whereby the sheets are able to stand on edge and upright in the bins by virtue of the beam strength thus imparted to them, said collector including guide means for directing the sheets to said one or more bins, said guide means being adapted to bend the sheets into the substantially curved configuration before they enter said one or more bins, said guide means terminating below said one or more bins.

2. A bottom-fed sheet collector as claimed in claim 1, comprising brush means for lifting the trail edges of the sheets from the guide means into the bin or bins.

3. A bottom-fed sheet collector as claimed in claim 2, comprising additional brush means for urging the trail edges of the sheets in the bin or bins into conformity against sheets previously collected in the bin or bins.

4. A bottom-fed sheet collector as claimed in claim 3, wherein the height of the bin or bins (taken in the direction of sheet feed into the bins) is substantially less than the corresponding dimension of the sheets to be collated.

5. A bottom-fed sheet collector as claimed in claim 4, wherein the bin or bins are defined by one or more upstanding plates, wherein each plate comprises several substantially flat sections, adjacent sections being mutually inclined transverse to the direction of sheet feed.

6. The bottom-fed sheet collector as claimed in claim 5 comprising means extending beneath the bin or bins for abutting the trail edge of the sheets contained therein.

7. A bottom-fed sheet collector as claimed in claim 3, including means for sorting the sheets having a plurality of upstanding sheet receiving bins, and indexed guide means for directing successive sheets respectively towards each of the bins in turn.

8. A bottom-fed sheet collector as claimed in claim 7, wherein the brushes are adapted to be indexed from bin to bin in timed relation with the guide means.

9. A bottom-fed sheet collector as claimed in claim 8, wherein the bins are defined by a parallel array of upstanding plates which are relatively movable apart and together, means being provided to hold two adjacent plates wider apart when the guide means is aligned for feeding a sheet into the bin defined between said two adjacent plates.

10. The bottom-fed sheet collector of claim 3, wherein said brush means and said additional brush means are positioned in a common horizontal plane and in different vertical planes.

11. The bottom-fed sheet collector of claim 1, wherein said irregular sheet support surface portions extend throughout said sheet support surface(s).

* * * * *